US005676563A

United States Patent [19]

Kondo et al.

[11] Patent Number: 5,676,563

[45] Date of Patent: Oct. 14, 1997

[54] SNOW-MELTING TILE WIRING UNIT

[75] Inventors: Masato Kondo; Masanobu Yoshimura, both of Yokkaichi, Japan

[73] Assignee: Sumitomo Wiring Systems, Ltd., Japan

[21] Appl. No.: 506,344

[22] Filed: Jul. 24, 1995

[30] Foreign Application Priority Data

| | | | |
|---|---|---|---|
| Sep. 26, 1994 | [JP] | Japan | 6-230060 |
| Sep. 26, 1994 | [JP] | Japan | 6-230061 |
| Sep. 26, 1994 | [JP] | Japan | 6-230062 |

[51] Int. Cl.[6] ..... H01R 11/00

[52] U.S. Cl. ..... 439/502; 439/435; 439/577

[58] Field of Search ..... 439/502–505, 439/193, 507, 577, 435

[56] References Cited

U.S. PATENT DOCUMENTS

| | | | |
|---|---|---|---|
| 4,291,673 | 9/1981 | Deutz . | |
| 4,508,399 | 4/1985 | Dowling et al. | 439/505 X |
| 4,941,845 | 7/1990 | Eppley et al. | 439/505 |
| 5,234,360 | 8/1993 | Kramer, Jr. | 439/505 |
| 5,453,916 | 9/1995 | Tennis et al. | 439/505 X |

FOREIGN PATENT DOCUMENTS

| | | |
|---|---|---|
| 9007207 | 6/1990 | European Pat. Off. . |
| 2256768 | 10/1990 | Japan . |
| 462764 | 5/1992 | Japan . |

*Primary Examiner*—Khiem Nguyen

*Attorney, Agent, or Firm*—Jordan B. Bierman; Bierman, Muserlian and Lucas LLP

[57] ABSTRACT

There is disclosed a snow-melting tile wiring unit which includes a main line (10) having two power supply cables (11), a main line connection plug (21) connected to one end of the main line (10), a main line receptacle connected to the other end of the main line (10), a predetermined number of main line branching molded portions (23) spaced on the main line (10) for connection between the main line (10) and branch lines (30) to be connected to snow-melting tiles (A), and branch line connection plugs (41) connected to the front end of the branch lines (30), wherein the branch line connection plugs (41) are connected to branch line receptacles (42) connected to the front end of leads (b) of the snow-melting tiles (A) each including a ceramic heater (B) deposited on the reverse face thereof, thereby electrically connecting the snow-melting tiles (A) to the main line (10).

8 Claims, 6 Drawing Sheets

SNOW-MELTING TILE WIRING UNIT

BACKGROUND OF THE INVENTION

1. Field of the Invention

The present invention relates to a snow-melting tile wiring unit for connection between a power supply and heaters of snow-melting roofing tiles used in snowy areas.

2. Description of the Prior Art

In snowy areas, snow piled up on the roof of a house causes the house to collapse unless it is removed and, thus, must be periodically removed from the roof of the house, which requires much hard labor. As shown in FIG. 8, snow-melting tiles 51 with heaters have been used which are laid entirely or partially on the roof. As a given amount of snow on the roof is detected by a sensor 52, the heaters of the snow-melting files 51 are actuated to automatically melt the snow, thereby lessening the labor of the snow removal.

Each snow-melting tile 51 is made by depositing a snow-melting ceramic heater on the reverse face of a normal roofing tile. To supply power to the ceramic heaters, the ceramic heaters of the respective snow-melting tiles 51 to be used are connected to a power supply with cables which are laid under the tiles.

The number and arrangement of tiles to be used for roofing vary depending upon the size and configuration of the house, that is, the size and configuration of the roof, and it is accordingly impossible to constantly wire the above described snow-melting tiles in specific patterns. Thus, it is necessary to design the wiring in each construction field depending on the size and configuration of the roof on which the snow-melting tiles are to be laid to accordingly execute the wiring, resulting in poor workability and high execution costs.

In particular, to connect each snow-melting tile to a main line connected to the power supply, branch lines are required to branch out from the main line. However, the connection of the respective branch lines to the main line requires excessive handling, and there is the danger of a short circuit resulting from water entering the junctures of the main line and the branch lines.

The snow-melting tile once laid on the roof and then subjected to damage from some cause or other must be replaced with a new one. However, the cable with which the damaged snow-melting tile is directly connected to the power supply must be subjected to some process or other. The replacement of the snow-melting tiles is time- and labor-consuming.

SUMMARY OF THE INVENTION

The present invention is intended for a snow-melting tile wiring unit for connecting a plurality of snow-melting tiles each including a heater to a power supply. According to a first aspect of the present invention, the snow-melting tile wiring unit comprises: a main line of a predetermined length; a main line connection plug connected to a first end of the main line; a main line receptacle connected to a second end of the main line and connectable to the main line connection plug; branch lines to be electrically connected at their first end to the heaters of the snow-melting tiles; and a predetermined number of main line branching molded portions spaced on the main line for electrically connecting the branch lines at their second end to the main line.

Preferably, according to a second aspect of the present invention, each of the main line branching molded portions includes a press-contact blade made of a conductive material for receiving therein the main line and the second end of one of the branch lines to electrically connect the main line to the one branch line.

Preferably, according to a third aspect of the present invention, each of the branch lines includes a branch line connection plug connected to the first end thereof and connectable to a branch line receptacle connected to a front end of a lead of one of the heaters.

Preferably, according to a fourth aspect of the present invention, the snow-melting tile wiring unit further comprises a waterproof cap mounted to one of the main line connection plug and the main line receptacle which is not connected.

Preferably, according to a fifth aspect of the present invention, each of the branch lines includes a flexible cable.

Preferably, according to a sixth aspect of the present invention, the main line or the main line branching molded portions are secured on a crosspiece on a roof with a fixing tool.

Preferably, according to a seventh aspect of the present invention, each of the branch lines includes a protector for covering a region thereof adjacent a corresponding one of the main line branching molded portions.

Preferably, according to an eighth aspect of the present invention, the protector is formed integrally with the corresponding main line branching molded portion.

In the first aspect of the present invention, a required number of snow-melting tile wiring units including a predetermined number of main line branching molded portions are prepared in accordance with the number of snow-melting tiles to be connected to the power supply and are coupled together by establishing a connection between the main line connection plugs and main line receptacles. The snow-melting tiles are connected to the branch lines. The main line connection plug or main line receptacle at one terminal of the coupled snow-melting tile wiring units is connected to the power supply.

In this manner, the use of the snow-melting tile wiring units is advantageous in that only the connection of the plurality of snow-melting tile wiring units can increase the wiring length thereof. To change the number of snow-melting tiles to be laid on the roof, it is only necessary to replace the snow-melting wiring unit at one terminal with another one having a required number of main line branching molded portions. This provides a high degree of freedom and good workability.

In the second aspect of the present invention, the main line and the branch line are easily electrically connected within a short period of time only by fitting them into the press-contact blade. The connecting portion thereof is molded from resin to prevent water from entering the connecting portion. This increase a waterproof property and heat-resistant lifetime.

In the third aspect of the present invention, when one of the snow-melting tiles laid on the roof is damaged, the branch line receptacle and branch line connection plug associated with the damaged snow-melting tile are disengaged to remove the damaged snow-melting tile from the snow-melting tile wiring unit. Then a new snow-melting tile is connected to the snow-melting tile wiring unit in the same manner as in laying the snow-melting tiles. The replacement of the snow-melting tiles is facilitated.

In the fourth aspect of the present invention, mounting the waterproof cap to the main line connection plug or main line receptacle at the other terminal does not cause a short circuit between the open terminals.

In the fifth aspect of the present invention, the branch line may include the flexible cable, which is deflected as required to accommodate a misalignment between the main line branching molded portions and the snow-melting tiles, providing increased workability.

In the sixth aspect of the present invention, the main line or main line branching molded portions are secured on the crosspiece on the roof with the fixing tool. Since the snow-melting tile wiring units are held in the connected position, a break due to disengagement between the main line connection plug and main line receptacle of adjacent snow-melting tile wiring units is effectively prevented.

In the seventh and eighth aspects of the present invention, the anti-break protector is formed integrally with the main line branching molded portion. When the branch line is bent during the process of laying the snow-melting tiles on the roof, less load is imposed on regions adjacent the main line branching molded portion of the branch line. This effectively prevents a break in the branch line adjacent the main line branching molded portion.

It is therefore a primary object of the present invention to provide snow-melting tile wiring units of good workability which are only required to be combined together to readily establish a connection between snow-melting tiles and a power supply without the need to design the wiring in each construction field depending on the size and configuration of a roof.

It is another object of the invention to provide a snow-melting tile wiring unit of good workability which includes easy-to-fabricate branch portions and which is highly water-resistant.

It is still another object of the invention to provide a snow-melting tile wiring unit of good workability which allows easy replacement of a damaged snow-melting tile laid on the roof and then damaged with a new one.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
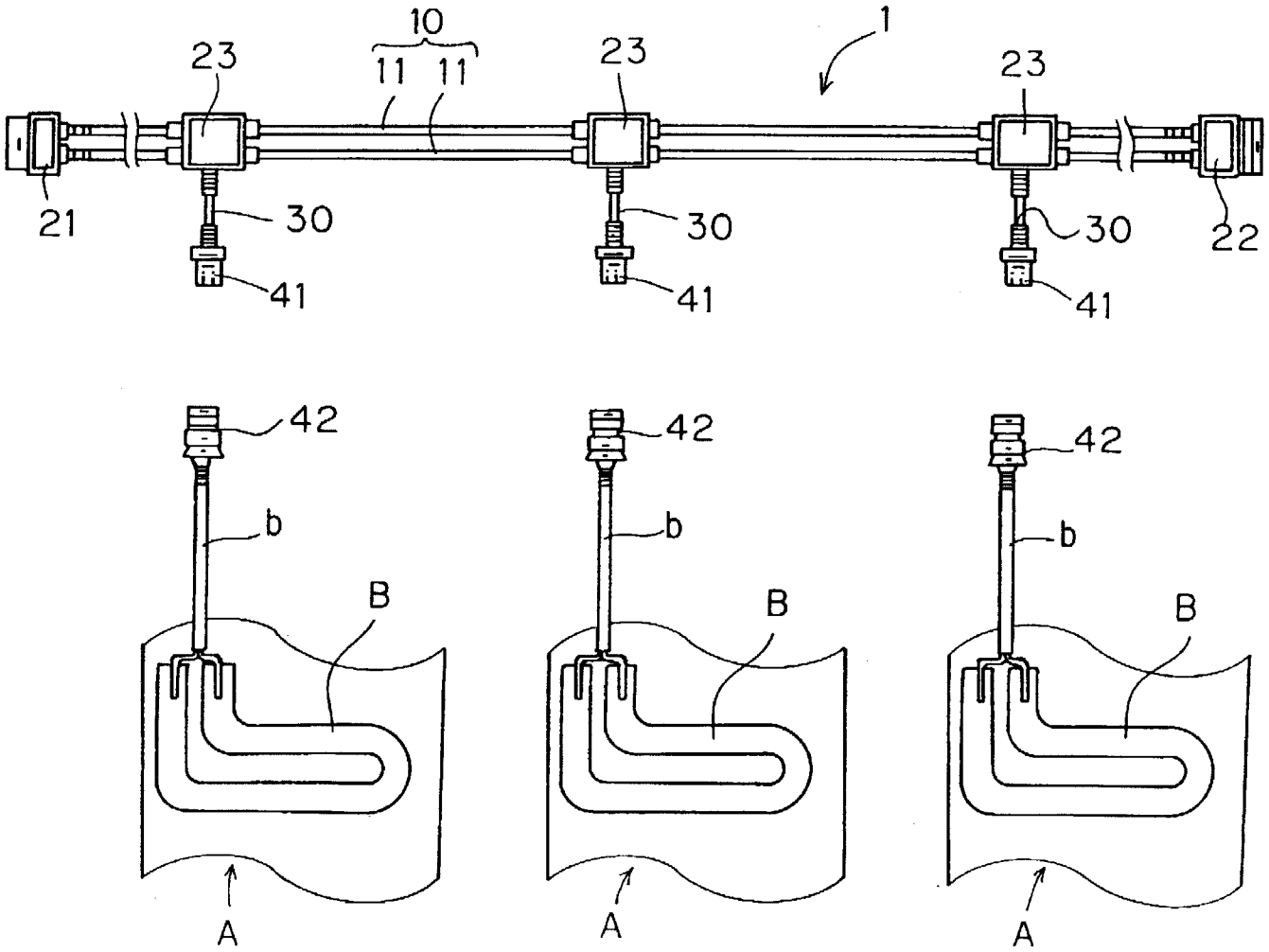
FIG. 1 is a plan view of a snow-melting tile wiring unit according to a preferred embodiment of the present invention.

A preferred embodiment of the present invention will now be described with reference to the drawings. Referring to FIG. 1, a snow-melting tile wiring unit 1 comprises: a main line 10 having two power supply cables 11; a main line connection plug 21 connected to one end of the main line 10; a main line receptacle 22 connected to the other end of the main line 10; a predetermined number of main line branching molded portions 23 spaced on the main line 10 for electrical connection between the main line 10 and branch lines 30 to be connected respectively to snow-melting tiles A; and branch line connection plugs 41 connected to the front end of the branch lines 30. The snow-melting tiles A each including a ceramic heater B deposited on the reverse face thereof are electrically connected to the main line 10 by establishing a connection between the branch line connection plugs 41 and branch line receptacles 42 connected to the front end of leads b of the snow-melting tiles A.

Figure 2A:
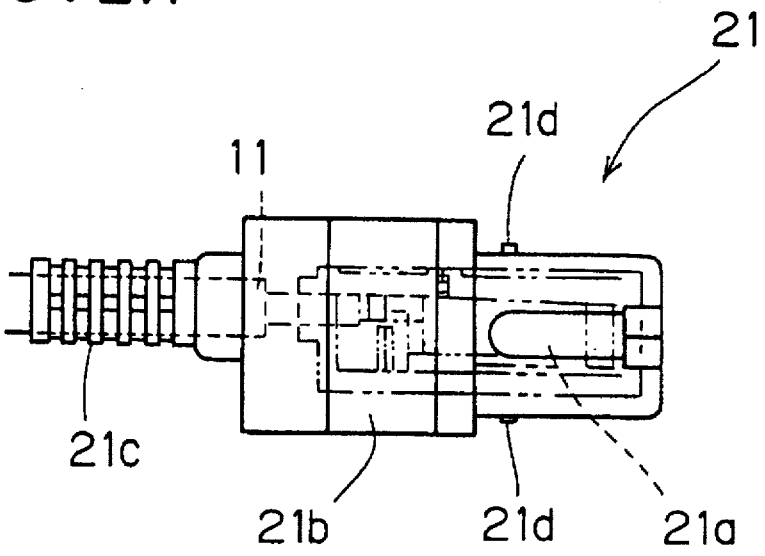
FIGS. 2A and 2B illustrate a main line connection plug of the snow-melting tile wiring unit.
Figure 2B:
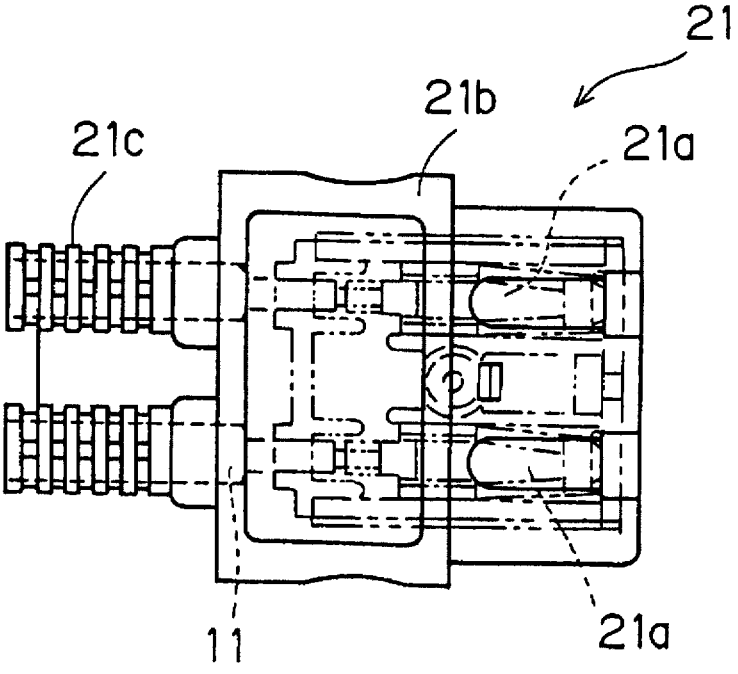

Referring to FIGS. 2A and 2B, the main line connection plug 21 includes a resin housing **21*b* formed by insert-molding female terminals 21*a* electrically connected respectively to the power supply cables 11, and flexible anti-break protectors 21*c* formed integrally with the resin housing 21*b* adjacent the resin housing 21*b* of the power supply cables 11**.

Figure 3A:
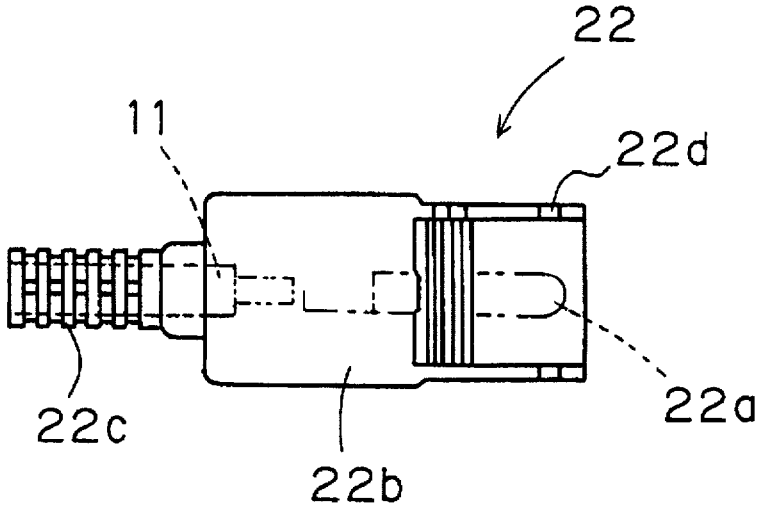
FIGS. 3A and 3B illustrate a main line receptacle of the snow-melting tile wiring unit.
Figure 3B:
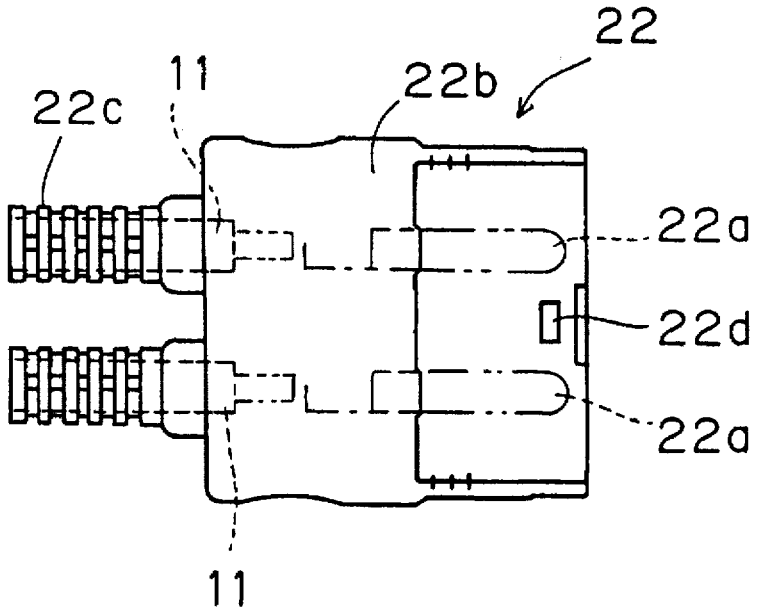

Referring to FIGS. 3A and 3B, the main line receptacle 22 includes a resin housing **22*b* formed by insert-molding resin into male terminals 22*a* in the shape of a round pin electrically connected respectively to the power supply cables 11, and flexible anti-break protectors 22*c* formed integrally with the resin housing 22*b* adjacent the resin housing 22*b* of the power supply cables 11**.

The main line connection plug 21 and the main line receptacle 22 are adapted such that the front ends of the resin housings **21*b* and 22*b* are made to fit together to insert the male terminals 22*a* into the female terminals 21*a* for electrical connection therebetween. In the fitted position, projections 21*d* formed on the resin housing 21*b* engage holes 22*d* formed in the resin housing 22*b* to lock the main line connection plug 21 and the main line receptacle 22 in the connected position. The main line connection plug 21 and main line receptacle 22** which are connected together are rendered waterproof.

Figure 4:
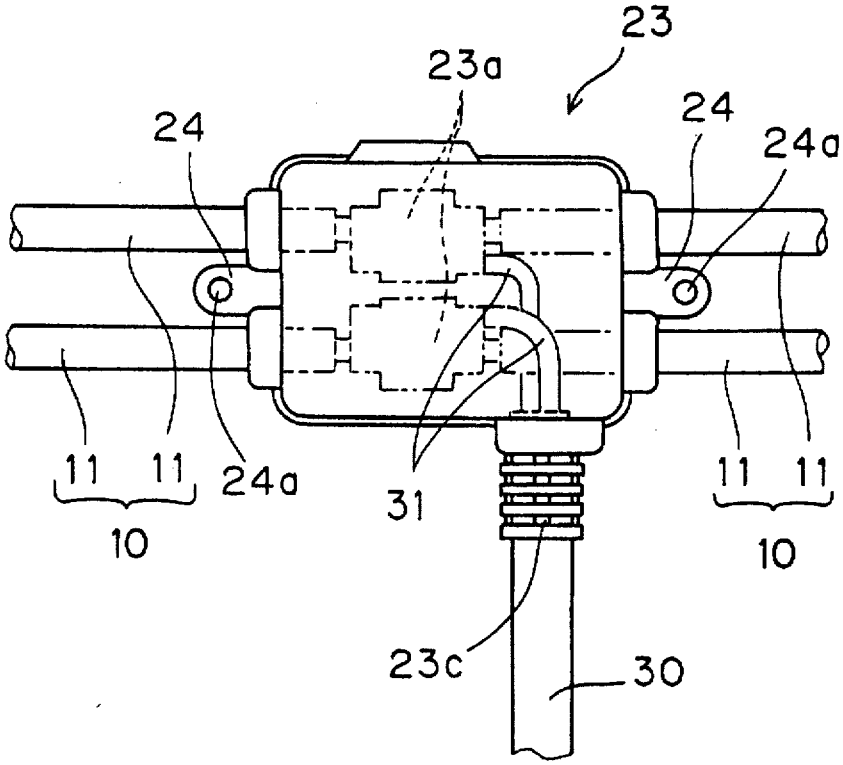
FIG. 4 is a plan view of a main line branching molded portion of the snow-melting tile wiring unit.

Referring to FIG. 4, each of the main line branching molded portions 23 includes connecting portions **23*a* molded from resin for electrical connection between the two power supply cables 11 of the main line 10 and two power supply cables 31 bundled together into one of the branch lines 30, and a flexible anti-break protector 23*c* formed integrally with the main line branching molded portion 23 adjacent the main line branching molded portion 23 of the branch line 30**.

Figure 5:
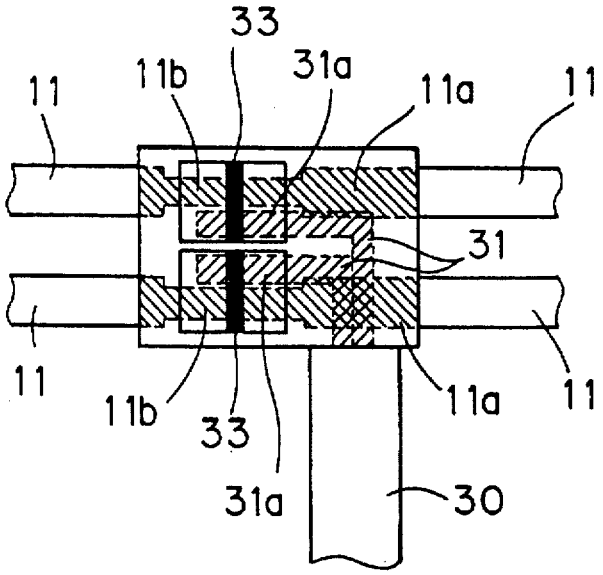
FIGS. 5 and 6 schematically illustrate a connection between a main line and a branch line in the main line branching molded portion.
Figure 6:
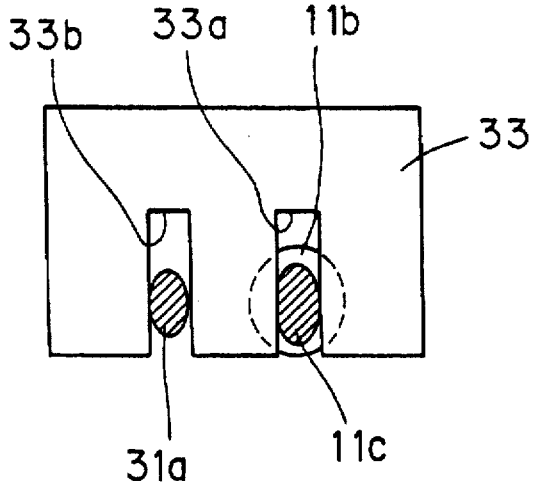

In each connecting portion **23*a*, as shown in FIGS. 5 and 6, an outer layer sheath 11*a* of the power supply cable 11 of the main line 10 is partially stripped off to expose an insulation coated portion 11*b*, and an insulation coated portion on the base end of the power supply cable 31 of the branch line 30 is stripped off to expose a core 31*a*. When the insulation coated portion 11*b* and the core 31*a* are forced respectively into slit portions 33*a* and 33*b* of a press-contact blade 33 made of a conductive material, the core 31*a* of the branch line 30 is directly electrically connected to the press-contact blade 33, and the slit portion 33*a* of the press-contact blade 33 elastically engages the surface of the insulation coated portion 11*b* of the main line 10 to electrically connect a core 11*c* of the main line 10 to the press-contact blade 33**.

The connecting portions **23*a* in which an electrical connection is made between the power supply cables 11 of the main line 10 and the power supply cables 31** of the branch line 30 in this manner are molded from resin as above noted to hold the connection and be rendered waterproof.

Each of the main line branching molded portions 23 further includes fixing portions 24 formed integrally therewith and each having a nail hole 24*a*. Nails passed through the nail holes 24*a* are driven into a crosspiece on the roof to secure the main line branching molded portions 23 on the roof.

Figure 7:
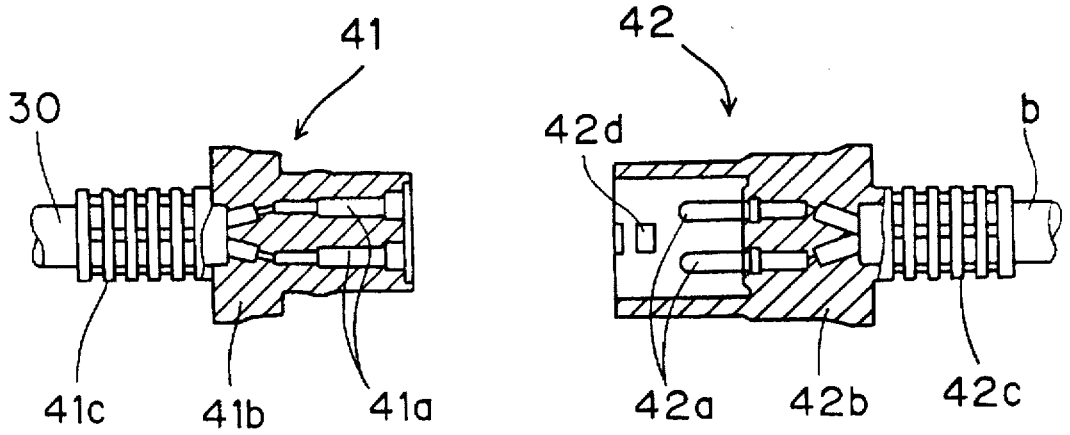
FIG. 7 is a sectional view, with portions broken away, of a branch line plug and a branch line receptacle of the preferred embodiment.
Figure 8:
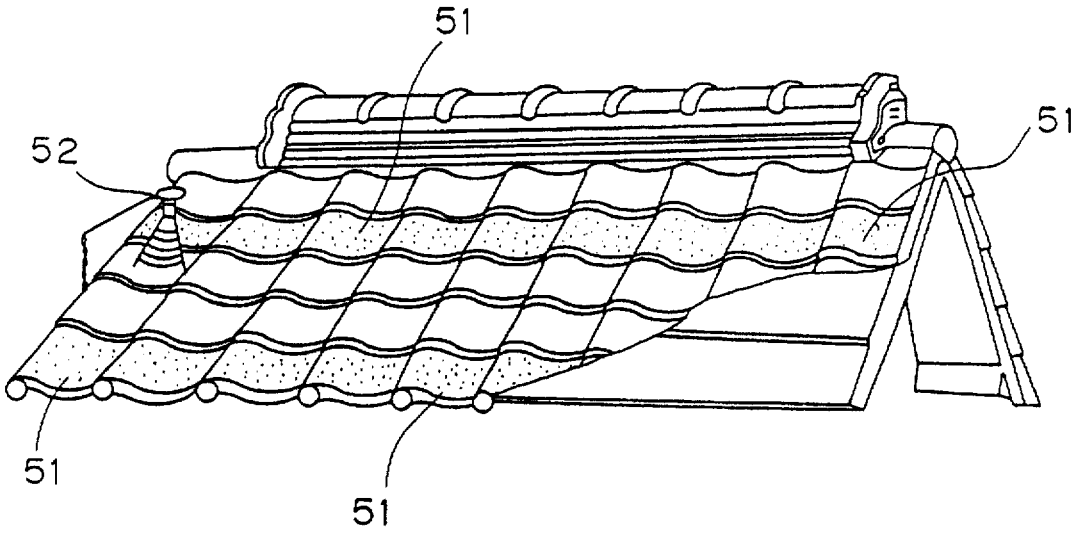
FIG. 8 PRIOR ART
FIG. 8 is a perspective view of snow-melting tiles laid on a roof.

The branch line connection plugs 41 and branch line receptacles 42 are of substantially identical construction with the main line connection plug 21 and the main line receptacle 22. Referring to FIG. 7, each of the branch line connection plugs 41 includes a resin housing 41*b* formed by insert-molding female terminals 41*a* electrically connected respectively to the power supply cables 31, and a flexible anti-break protector 41*c* formed integrally with the resin housing 41*b* adjacent the resin housing 41*b* of the power supply cables 31. Each of the branch line receptacles 42 includes a resin housing 42*b* formed by insert-molding resin into male terminals 41*a* in the shape of a round pin electrically connected to one of the leads b of the snow-melting tiles A, and a flexible anti-break protector 42*c* formed integrally with the resin housing 42*b* adjacent the resin housing 42*b* of the lead b.

Each pair of branch line connection plugs 41 and branch line receptacles 42 are adapted such that the front ends of the resin housings 41*b*, 42*b* are made to fit together to insert the male terminals 42*a* into the female terminals 41*a* for electrical connection therebetween. In the fitted position, a projection (not shown) formed on the resin housing 41*b* engages a hole 42*d* formed in the resin housing 42*b* to lock each pair of branch line connection plugs 41 and branch line receptacles 42 in the connected position. Each pair of branch line connection plugs 41 and branch line receptacles 42 which are connected together is rendered waterproof.

The power supply cables 31 of the branch lines 30 and the leads b of the snow-melting tiles A are both flexible. A misalignment between the main line branching molded portions 23 and the snow-melting tiles A being laid on the roof is accommodated by deflecting the power supply cables 31 and the leads b of the snow-melting files A.

Laying the snow-melting tiles A on the roof by using the snow-melting tile wiring unit 1 as above constructed will be discussed hereinafter. First, a required number of snow-melting tile wiring units 1 are prepared on the basis of the number of snow-melting tiles A to be laid and the number of main line branching molded portions 23 in one snow-melting tile wiring unit 1. When the number of snow-melting tiles is not equal to the number of main line branching molded portions 23, then prepared are one or more snow-melting tile wiring units 1 having a predetermined number of main line branching molded portions 23 and one snow-melting tile wiring unit 1 of another type wherein the number of main line branching molded portions 23 equals an odd sum or remainder. For example, when the snow-melting tile wiring units 1 each having 10 main line branching molded portions 23 are used for 37 snow-melting tiles to be laid on the roof, then prepared are three snow-melting tile wiring units 1 each having 10 main line branching molded portions 23 and one snow-melting tile wiring unit 1 each having 7 main line branching molded portions 23. Thus, it is necessary to previously fabricate several types of snow-melting tile wiring units 1 having different numbers of branches.

A plurality of snow-melting tile wiring units 1 prepared are connected in series by connecting the main line connection plugs 21 and main line receptacles 22 thereof and then mounted on a sarking of the roof. The main line branching molded portions 23 are secured on the crosspiece with nails through the nail holes 24*a* of the fixing portions 24. The main line connection plug 21 at one end of the series connected snow-melting tile wiring units 1 is connected to a power supply, and a waterproof cap (not shown) is fitted to the main line receptacle 22 at the other end thereof for terminal process.

Such terminal process prevents a short circuit resulting from an accidental electrical connection of the male terminals 22*a* of the main line receptacles 22 due to some cause or other and provides good workability. Further, since the coupled snow-melting tile wiring units 1 are held connected together by securing the main line branching molded portions 23 on the crosspiece, a break resulting from a disconnection between the main line connection plug 21 and main line receptacle 22 of adjacent snow-melting tile wiring units 1 is effectively prevented.

Finally, the branch line connection plugs 41 and branch line receptacles 42 are connected to connect the snow-melting tiles A to the snow-melting tile wiring units 1, and the snow-melting tiles A are laid in position on the roof. At this time, a misalignment, if caused, between the main line branching molded portions 23 of the mounted snow-melting tile wiring units 1 and the position in which the snow-melting tiles A are to be laid is adjusted by deflecting the branch lines 30 and the leads b. The branch lines 30 and the leads b are flexible and readily deflected as noted above, and the deflection eliminates the problem of the disengagement between the branch line connection plugs 41 and branch line receptacles 42. The provision of the anti-break protectors adjacent the main line branching molded portions of the branch lines 30 prevents a load from being directly imposed on regions adjacent the main line branching molded portions of the branch lines 30 deflected when the snow-melting tiles A are laid, thereby effectively preventing a break in the lines.

When one of the snow-melting tiles A laid on the roof is damaged due to some cause or other, only the damaged snow-melting tile A is replaced with a new one. The snow-melting tile A is readily replaced only by the disconnection and connection of the branch line connection plug 41 and branch line receptacle 42 associated with the snow-melting tile A. This provides good workability.

In this preferred embodiment, the snow-melting tile wiring unit 1 to be mounted is secured by nailing the main line branching molded portions 23 on the crosspiece. However, the portion to be fixed is not limited to the main line branching molded portions 23, and the fixing means is not limited to the nails. For example, the power supply cables 11 may be clamped on the crosspiece.

While the invention has been shown and described in detail, the foregoing description is in all aspects illustrative and not restrictive. It is therefore understood that numerous modifications and variations can be devised without departing from the scope of the invention.

What is claimed is:

1. A tile wiring unit comprising a plurality of tiles, each having an electrically powered heater, an electrically conductive main line having a first end and a second end, a main line connection plug connected to said first end, a main line receptacle connected to said second end, one of said main line plug and said main line receptacle connected to a source of electrical power, a plurality of electrically conductive branch lines spaced apart along said main line, each having an input end and an output end, each said output end being electrically connected to said heater, said branch line has a branch line plug at said output end and in electrical contact therewith, said branch line plug electrically connected to a branch line receptacle which, in turn, is electrically connected to said heater.

2. A wiring unit for roof tiles, each of said tiles having an electrically powered heater, said unit comprising an electrically conductive main line having a first end and a second end, a main line connection plug connected to said first end, a main line receptacle connected to said second end, one of said main line plug and said main line receptacle connected to a source of power, said main line comprising a first pair of spaced apart parallel power supply cables, a plurality of electrically conductive branch lines spaced apart along said main line, each said branch line comprising a second pair of parallel power supply lines, each said branch line having an input end and an output end, each said output end electrically connected to said heater, each said input end electrically connected to said main line at a molded branched portion, said molded branched portion comprising a conductive press-contact blade, said first pair and said second pair being in said molded branched portion, each of said first pair being electrically connected to each of said second pair through said blade, said wiring unit being under said roof tiles.

3. The wiring unit of claim 2 wherein there is a plurality of main lines, connected to each other by mating of a main line plug on one said unit and a main line receptacle on another said unit.

4. The tile wiring unit of claim 2 comprising a waterproof cap on one of said main line connection plug and said main line receptacle which is not connected.

5. The tile wiring unit of claim 2 wherein said branch line includes a flexible cable.

6. The tile wiring unit of claim 2 wherein said molded branched portion has at least one tab with a hole therethrough, said molded branched portion affixed to said roof.

7. The tile wiring unit of claim 2 wherein said branch line includes a protector for covering a region thereof adjacent a corresponding said main line branching molded portion.

8. The tile wiring unit of claim 7 wherein said protector is formed integrally with said corresponding main line branching molded portion.

* * * * *